US006263811B1

(12) United States Patent
Crossley

(10) Patent No.: US 6,263,811 B1
(45) Date of Patent: Jul. 24, 2001

(54) TUFTING MACHINE FOR OVERTUFTING PATTERNS

(75) Inventor: Philip Harold Crossley, Blackburn (GB)

(73) Assignee: Spencer Wright Industries, Inc., Dalton, GA (US)

( * ) Notice: Subject to any disclaimer, the term of this patent is extended or adjusted under 35 U.S.C. 154(b) by 0 days.

(21) Appl. No.: 09/613,133

(22) Filed: Jul. 10, 2000

(30) Foreign Application Priority Data

Dec. 16, 1999 (GB) ..... 9929827

(51) Int. Cl.[7] ..... D05C 11/06; D05C 11/00
(52) U.S. Cl. ..... 112/80.4; 112/80.73
(58) Field of Search ..... 112/80.4, 80.44, 112/80.43, 80.41, 80.42, 80.7, 80.73

(56) References Cited

U.S. PATENT DOCUMENTS

| | | | | |
|---|---|---|---|---|
| 4,815,402 | | 3/1989 | Price . | |
| 4,831,948 | * | 5/1989 | Itoh et al. | 112/80.43 |
| 4,852,505 | | 8/1989 | Dedmon . | |
| 5,143,003 | | 9/1992 | Dedmon . | |
| 5,383,415 | * | 1/1995 | Padgett, III | 112/80.73 |
| 5,706,744 | * | 1/1998 | Card et al. | 112/80.41 |
| 6,202,580 | * | 3/2001 | Samillo | 112/80.73 |

FOREIGN PATENT DOCUMENTS 2246371 7/1992 (GB) .

* cited by examiner

*Primary Examiner*—Ismael Izaguirre
(74) *Attorney, Agent, or Firm*—Alan Ruderman; Stephen J. Stark

(57) ABSTRACT

A tufting machine with a pair of closely spaced apart needle bars which reciprocate together but the needles carried by one bar may be controlled selectively to be either in a position to form pile or be retracted to a position where they do not form pile when the needle bars are driven toward the backing material selectively. A control system is provided to control the selection of the needles of the one needle bar and also the feeding of yarn to the needles of the one needle bar so that yarn from needles which are not tufting is drawn tight on the backing. The needles may be mounted in modules and selected needle modules may be independently controllable by pneumatic cylinders so that various overtufted patterns may be made by the controlled needles in a background formed by the needles in the other bar that tuft on every stitch.

12 Claims, 4 Drawing Sheets

TUFTING MACHINE FOR OVERTUFTING PATTERNS

BACKGROUND OF THE INVENTION

The present invention relates to a tufting machine for tufting a background pile and inserting or overtufting additional pile at predetermined locations to form a pattern in the background pile.

In the tufted carpet industry, there is a demand for machines which are able to produce a carpet of one or more background colors with an intermittent pattern of one or more pattern colors. Such a carpet is conventionally produced in one of two different ways.

The most common process is to bury the color used for the pattern in the parts of the carpet where the pattern is not required. This is done by tufting with the pattern color at the lowest possible pile height in the areas between the pattern. This is reasonably satisfactory for carpets with a high pile height. However, even then, it is difficult to control the yarn feed to produce a single tuft of the pattern, and it is also wasteful of yarn to tuft at a low pile height in areas that will not be seen. However, the real problem with this method is for carpets with a low pile height, for which there is an increasing demand in certain markets, where it becomes impossible to hide the buried color. This technique is therefore not suitable for producing such patterned carpets at low pile heights.

A second technique is known as overtufting. This is simply where the carpet is tufted by a first tufting machine with the background color, and is then fed through a second tufting machine where the pattern is tufted into the carpet, the second machine being a controlled needle individual controlled needle machine. Examples of this process are illustrated in U.S. Pat. Nos. 4,693,190 and 4,726,306. With this method precise control of the positioning of the pattern is impossible preventing a tuft of the pattern from being placed precisely between tufts of the background color. Not only can this affect the aesthetics, but it can also cause tufts of the background color to be punched out, pierced or split as the pattern is created making this method generally unsuitable for loop pile carpets. Additionally, the machines which produce these fabrics are controlled needle cut pile machines, loop pile machines of such type not being known. Also, as passes through two tufting machines are required, this process is slow.

SUMMARY OF THE INVENTION

According to the present invention, provides a tufting machine having first and second needle bars which are reciprocably operable within the housing and on each of which a plurality of needles are mounted for reciprocating toward and away from a web of backing material fed through the machine, the first and second needle bars being spaced in the direction in which the web travels through the machine, and a control mechanism which controls the reciprocation of the needles on one needle bar independently of those on the other needle bar.

By providing two needle bars with independent control, one can be used to tuft the background, while the other can be used to tuft the pattern. Because the two sets of needles are independently controllable, the one set of needles which is tufting the pattern can be stopped from tufting when the pattern is not required. Thus, rather than tufting the pattern with a low pile height, the yarn for the pattern can simply be left to trail along the back of the carpet when it is not being used to create the pattern. Not only does this use less yarn than is required to tuft with a low pile height, but most importantly, it is impossible to see even when the background is tufted with a very low pile height.

Further, the independent control of the two needle bars allows a pattern requiring only a single tuft of the pattern at any one point to be tufted, thereby producing a well defined pattern.

The two needle bars may be very easily positioned with respect to one another. This means that the loopers which produce the background can be precisely aligned with respect to the loopers which produce the pattern such that very precise positioning of the pattern with respect to the background can be achieved. For example, the machine of the present invention can produce a carpet in which the pattern is precisely located between rows of the background. This avoids the problems associated with overtufting in which background tufts can be punched out and where it is not possible to control the position of the needles which produce the background with respect to the needles which produce the pattern. The invention can therefore be used for both cut and loop pile tufting machines.

The first and second needle bars may each be provided with their own entirely independent reciprocating mechanism. However, to reduce the complexity of the machine, and to provide better control of the synchronization of the two needle bars, the preferred mode of the invention is for the two bars to share a common drive mechanism, and for the needles of at least one of the bars to be retractable independently of the needles on the other needle bar. In practice, to produce a carpet with a background and a pattern, it is only necessary to have retractable needles on the needle bar used to produce the pattern. In this way, the drive mechanism will reciprocate both needle bars. When the needles on the needle bar tufting the pattern are retracted, only the background color will be tufted. At this time, the yarn to these needles trails along the back of the backing medium. A yarn feed mechanism may then control the feed of yarn so that this yarn is tight to the back of the carpet. On each occasion when a tuft of pattern is required, the needles on the bar forming the pattern are moved to their extended position, whereupon they begin tufting together with the needles producing the background. The needles can be extended only for long enough to create a single tuft if necessary.

The needles may be retractable using any suitable mechanism such as a mechanical, electromagnetic or hydraulic mechanism, but the current preference is for a pneumatically operated retraction mechanism.

In order to allow more complex patterns to be produced, it is preferable for at least one of the needle bars to be moveable transversely to the direction in which the backing material is fed through the machine. If the needles forming the pattern are laterally moveable in this way, then they can be controlled to move across the web between pattern tufts, thereby allowing an offset or checkerboard pattern to be produced.

The present invention is applicable to a tufting machine in which the needles are mounted via needle modules, and a plurality of such needle modules are mounted to each needle bar. In this case, on at least one of the needle bars, the reciprocation of each module can be independently controlled to allow more complex patterns to be produced. As an extension of this, it is envisaged that on at least one of the bars the reciprocation of each needle may be independently controllable, as in the known individual controlled needle machines one of which is illustrated in U.S. Pat. No. 5,653,184, to provide an even greater degree of flexibility.

DESCRIPTION OF PREFERRED EMBODIMENT

Figure 1:
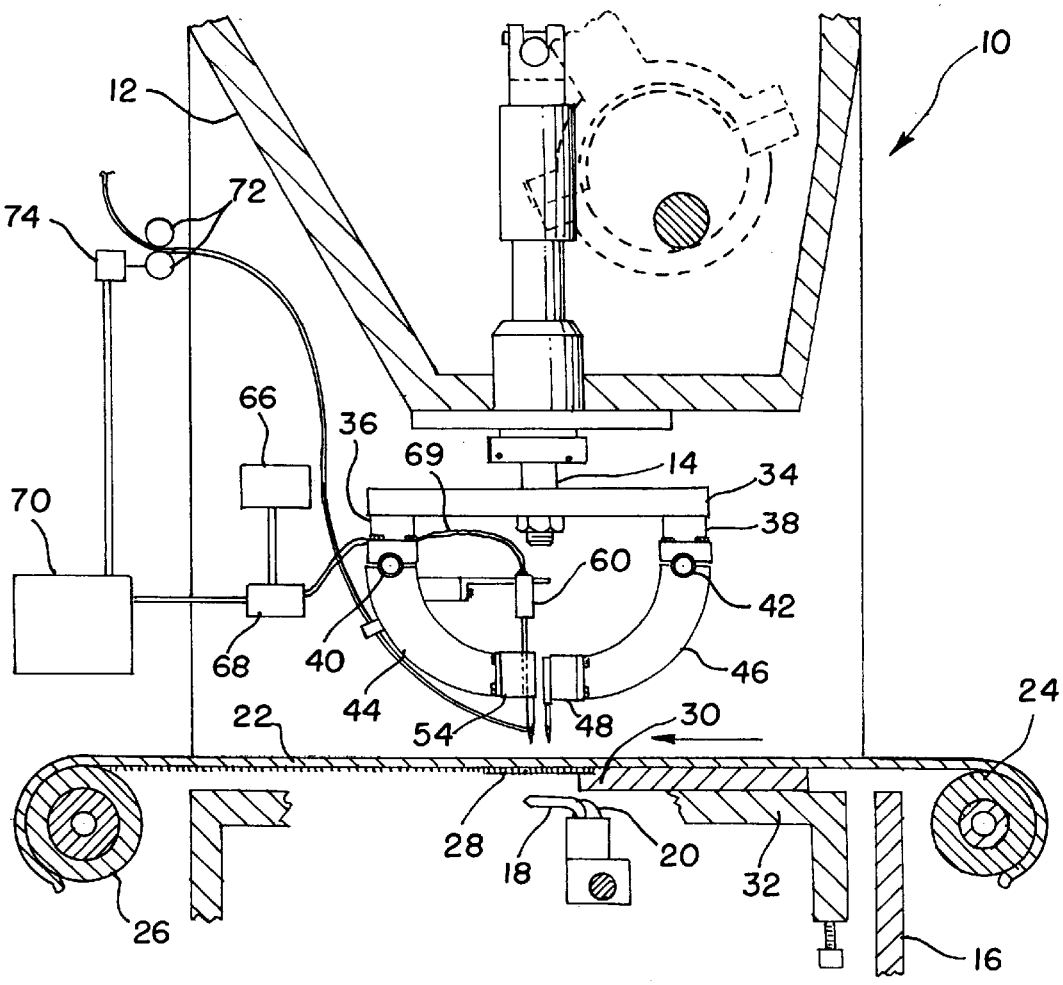
FIG. 1 is a fragmentary end elevational view of a loop pile tufting machine incorporating features constructed in accordance with the present invention.
Figure 2:
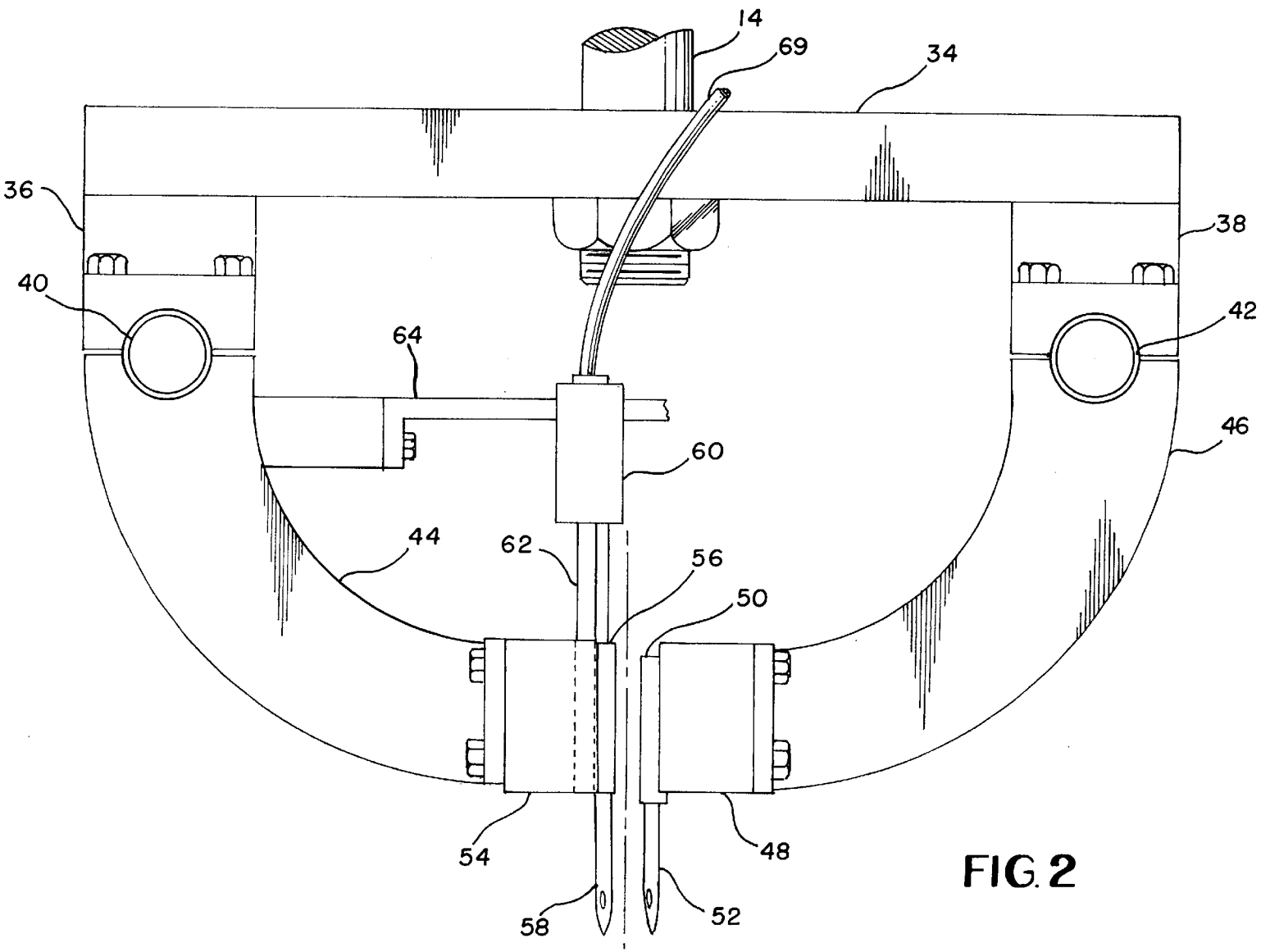
FIG. 2 is an enlarged portion of the drive illustrated in FIG. 1.

Referring to the drawing, FIG. 1 illustrates a portion of the tufting machine 10 having a housing including a head 12 within which is mounted drive mechanism for reciprocably driving a plurality of push rods 14 (only one of which is illustrated), the drive mechanism being conventional drive means such as that illustrated in U.S. Pat. No. 3,986,465 or other conventional drive means for reciprocably driving push rods. Additionally, the tufting machine conventionally includes a bed 16 disposed beneath the head and within which are mounted a plurality of loop seizing members such as loopers 18, 20 which are conventionally oscillated in time relationship with the reciprocation of the push rods to seize loops of yarn from the needles as hereinafter made clear. The machine illustrated is a loop pile machine in which the loopers point in a direction of a backing material feed, the backing material 22 being fed through the machine by roller members 24, 26 over needle fingers 28 carried by a finger plate 30 on a bed plate 32.

The push rods 14 in the preferred embodiment may be connected to a respective bridge member 34 which carries a support foot 36, 38 at each end. Securely connected in each support foot 36, 38 transverse to the axes of the push rods 14 is at least one linear bearing (not illustrated) which journally carries a respective guide rod 40, 42 for movement transversely to the direction in which the backing material 22 is fed. The guide rod 40 is clamped to a first bracket 44 while the guide rod 42 is clamped to a second bracket 46. Alternatively the guide rods 40, 42 may be clamped to the respective foot 36, 38 and be connected to the brackets 44, 46 by means of linear bearings as in U.S. Pat. No. 5,427,039. In any event, the brackets 44, 46 may be moved transversely relative to the backing material 22, and yet reciprocate vertically toward and away from the backing material 22.

The bracket 46 remote from the first rod 42 is fastened to a first needle bar 48 on which a plurality of first needle modules 50 are fixed. Each first needle module 50 is provided with a plurality of first needles 52 forming a line of needles extending across the width of the tufting machine.

A second needle bar 54 is fastened to the bracket 44 remote from the guide rod 40 and a plurality of second needle modules 56 each having a plurality of second needles 58 are mounted to the second needle bar 54 so as to be reciprocably driven in a vertical direction. The second needle modules 56, if desired, may be provided with less needles than the first needle modules 50 depending on the nature of the pattern required. As described, one or both of the needle bars 48, 54 may be laterally or transversely movable with the respective brackets 44, 46.

The second needle bar 54 supports a pneumatic retraction assembly. This assembly is also mounted so as to be reciprocally driven and laterally moveable with the bracket 44. The pneumatic assembly consists of several pneumatic cylinders 60 containing a piston (not shown) from which a rod 62 extends. The rod 62 is rigidly coupled to one or more of the second needle modules 56, preferably one. The pneumatic cylinders 60 may be coupled to the second needle bar 54 by a bracket 64 which may be connected to the needle bar 54 or, as illustrated, may be connected to the bracket 44.

Air may be supplied to the respective pneumatic cylinder 60 from a compressor 66 through electrically controlled pneumatic valves 68 which permit air to flow through lines 69 to the respective cylinders as determined by a pattern controller 70 such as a computer driven system driven by pattern information.

Figure 3:
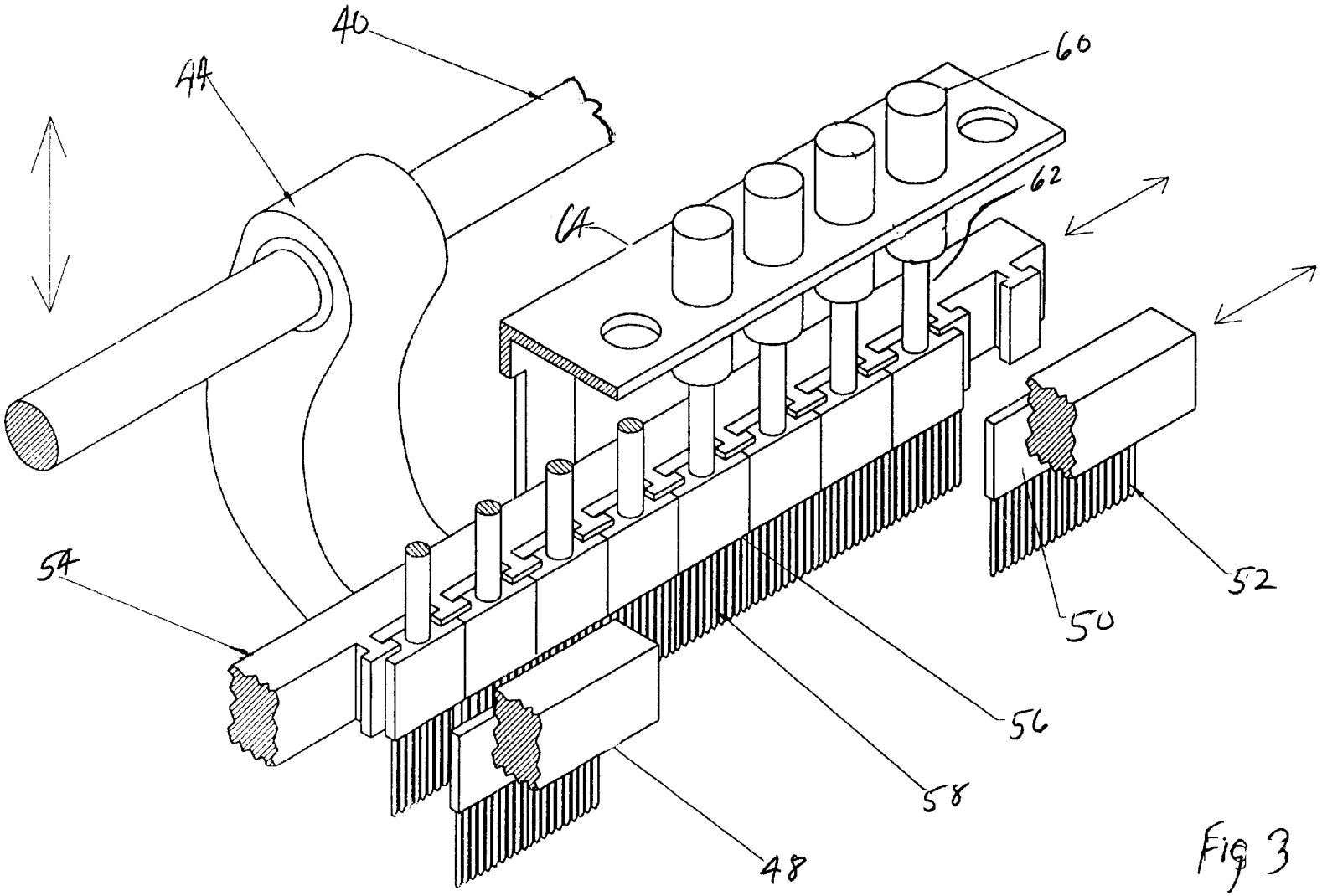
FIG. 3 is a schematic perspective view through a portion of the tufting machine showing the needle bars and the actuation mechanism with all needles on the pattern forming bar retracted.

As shown in FIG. 3, the second needle modules 56 are all in the retracted position. In this position, as the push rods together with the brackets 44, 46 reciprocate, the first and second needle bars 48, 54 and the pneumatic retraction assembly, only the first needles 52 will engage with the backing material 22 to tuft the carpet. At this time, the yarn feed rate to the second needles 58 may be controlled by a yarn feed rolls 72 driven by a servo-motor 74 controlled by the controller 70 to be significantly less than the yarn feed to the first needles 52 so that the yarn from the second needles 58 when not tufting will be tight on the back of the backing 22.

Figure 4:
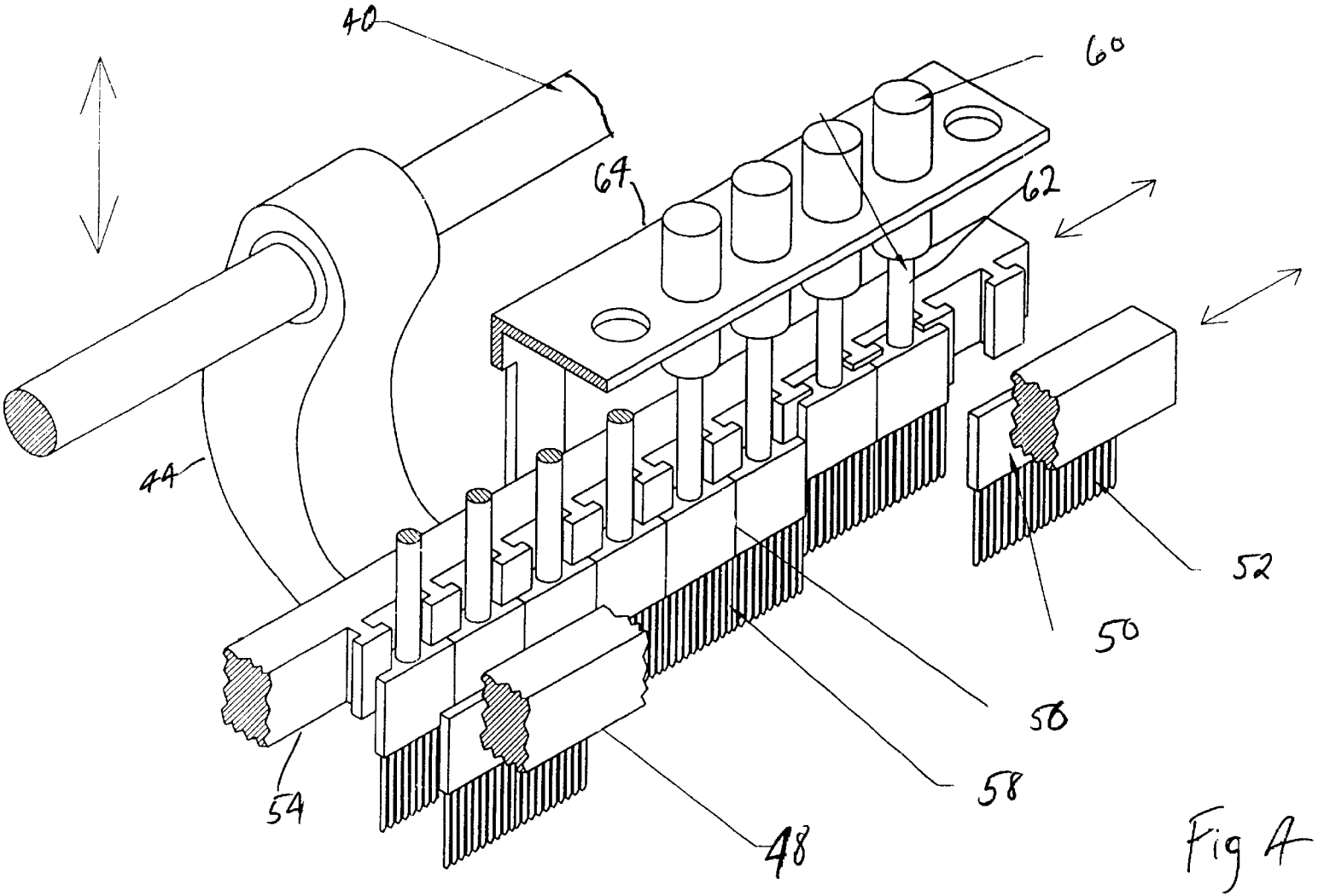
FIG. 4 is a similar view to FIG. 3 with some needles extended.

When the second needles 58 are required to produce the pattern, the pneumatic cylinders 60 are selectively actuated when the needle is out of the backing medium to move their corresponding piston rod 62, second needle module 56 and second needles 58 downwardly so as to bring the second needles 58 level with the first needles 52. In FIG. 4, the six second needle modules 56 on the left are shown in this extended configuration. At this time, the yarn feed rate is increased to a rate which allows the pattern to be tufted at the required pile height.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting machine comprising a housing, first and second needle bars which are reciprocably operable within the housing and on each of which a plurality of needles are mounted, a bed over which a web of backing material may be fed through the machine, said needles reciprocable towards and away from said bed and thus the web, said first and second needle bars being spaced apart in the direction in which the web travels through the machine, a control mechanism which controls the reciprocation of the needles of the first needle bar independently of those of the second needle bar, and a yarn feed mechanism controlled by said control mechanism to control the feed of yarn to the first needle bar so that the yarn from needles which are not tufting is tight on the backing.

2. A machine according to claim 1, wherein the two bars share a common drive mechanism, and the needles of at least one of the bars are retractable independently of the needles of the other bar.

3. A machine according to claim 2, wherein at least one of the needle bars is movable transversely to the direction to which the backing material is fed through the machine.

4. A machine according to claim 2, wherein the needles are mounted on needle modules, and a plurality of such needle modules are mounted to each needle bar.

5. A machine according to claim 4, wherein the reciprocation of each module of said at least one of the bars is independently controllable.

6. A machine according to claim 2, wherein the needles are pneumatically retractable.

7. A machine according to claim 6, wherein the needles are mounted on needle modules, and a plurality of such needle modules are mounted to each needle bar.

8. A machine according to claim 7, wherein the reciprocation of each module of said at least one of the bars is independently controllable.

9. A machine according to claim 1, wherein at least one of the needle bars is movable transversely to the direction to which the backing material is fed through the machine.

10. A machine according to claim 1, wherein the needles are mounted on needle modules, and a plurality of such needle modules are mounted to each needle bar.

11. A machine according to claim 5, wherein the reciprocation of each module of said at least one of the bars is independently controllable.

12. A machine according to claim 1, wherein the reciprocation of each needle is independently controllable.

* * * * *